US005762056A

United States Patent [19]

Kysilka

[11] Patent Number: 5,762,056

[45] Date of Patent: Jun. 9, 1998

[54] SLING BOW

[76] Inventor: James Otto Kysilka, P.O. Box 1581, Fargo, N. Dak. 58107-1581

[21] Appl. No.: 739,719

[22] Filed: Oct. 29, 1996

[51] Int. Cl.[6] ..... F41B 7/00

[52] U.S. Cl. ..... 124/20.3; 124/20.1; 124/87

[58] Field of Search ..... 124/20.3, 20.1, 124/26, 21, 22, 87

[56] References Cited

U.S. PATENT DOCUMENTS

| | | | |
|---|---|---|---|
| 1,345,561 | 7/1920 | Smithwick | 124/20.1 |
| 1,375,776 | 4/1921 | Buys | 124/22 X |
| 2,645,217 | 7/1953 | Fisher | 124/20.3 |
| 2,807,254 | 9/1957 | Stribling | 124/20.1 |
| 3,018,770 | 1/1962 | Saunders . | |
| 3,455,288 | 7/1969 | Knerr . | |
| 3,517,657 | 6/1970 | Alban . | |
| 3,918,427 | 11/1975 | Turner . | |
| 3,983,860 | 10/1976 | Bolton | 124/20.1 |
| 4,169,453 | 10/1979 | Hunsicker . | |
| 4,297,985 | 11/1981 | Rodriguez | 124/22 |
| 4,332,230 | 6/1982 | Lozier . | |
| 4,373,503 | 2/1983 | Saunders . | |
| 4,411,248 | 10/1983 | Kivenson | 124/20.1 |
| 4,437,449 | 3/1984 | Attanasio . | |
| 4,458,658 | 7/1984 | Blair . | |
| 4,573,445 | 3/1986 | Webb et al. . | |
| 4,668,344 | 5/1987 | Mitchell | 124/22 X |
| 4,703,744 | 11/1987 | Taylor et al. | 124/20.3 X |
| 4,873,963 | 10/1989 | Lemmen . | |
| 4,877,007 | 10/1989 | Olson . | |
| 4,911,136 | 3/1990 | Brown . | |
| 5,072,715 | 12/1991 | Barr . | |
| 5,125,388 | 6/1992 | Nicely et al. . | |
| 5,243,955 | 9/1993 | Farless . | |
| 5,279,276 | 1/1994 | Nagel et al. . | |
| 5,501,207 | 3/1996 | Black . | |

*Primary Examiner*—Terry Lee Melius
*Assistant Examiner*—Thomas A. Beach
*Attorney, Agent, or Firm*—Merchant, Gould, Smith, Edell, Welter & Schmidt, P.A.

[57] ABSTRACT

A preferred embodiment sling bow has rigid guide tubes mounted to a universal frame which allows both the handle and guide tube assembly to pivot. The elastic thrust tubes are disposed inside the rigid guide tubes and secured to their forward ends with tension adjusters. A pull-limiting/safety line is disposed inside each elastic tube and is connected to the bow string proximate the rearward end of the elastic tube and to the tension adjuster proximate the forward end of the elastic tube. Sights are mounted on the upper guide tube, and arrow rests are installed between the two guide tubes. A pull knob or pull loop is secured to the bow string center position. When the bow string is pulled back, the arrow will stay aligned with the sights due to the universal pivot feature of the sling bow. Features or the preferred embodiment include ultra violet (UV) degradation protection of the elastic tubes, safety protection for the shooter if an elastic tube should break or become detached from its mounting, over-draw protection, right or left-hand shooting capability, and collapsibility of the sling bow handle parallel to the guide tubes to facilitate storage in a pocket, holster, or backpack.

20 Claims, 3 Drawing Sheets

SLING BOW

FIELD OF THE INVENTION

The present invention relates to elastic resistance devices and in a preferred embodiment, to sling bows and other sorts of hand-held, projectile launching devices.

BACKGROUND OF THE INVENTION

Slingshots, slingbows, and the like are known in the art as evidenced by U.S. Pat. No. 3,018,770 to Saunders; U.S. Pat. No. 3,455,288 to Knerr; U.S. Pat. No. 3,517,657 to Alban; U.S. Pat. No. 3,918,427 to Turner; U.S. Pat. No. 4,169,453 to Hunsicker; U.S. Pat. No. 4,332,230 to Lozier; U.S. Pat. No. 4,373,503 to Saunders; U.S. Pat. No. 4,437,449 to Attanasio; U.S. Pat. No. 4,458,658 to Blair; U.S. Pat. No. 4,573,445 to Webb et al.; U.S. Pat. No. 4,873,963 to Lemmen; U.S. Pat. No. 4,877,007 to Olson; U.S. Pat. No. 4,911,136 to Brown; U.S. Pat. No. 5,072,715 to Barr; U.S. Pat. No. 5,125,388 to Nicely et al.; U.S. Pat. No. 5,243,955 to Farless; U.S. Pat. No. 5,279,276 to Nagel et al.; and U.S. Pat. No. 5,501,207 to Black. Despite these efforts, there continues to be room for improvement in this field. For example, when the elastic bands or tubes of prior art devices are drawn backward to a "loaded" position, the handle is susceptible to undesirable twisting movement, and the bow string is susceptible to deflection horizontally and/or vertically. Any of these events tends to negatively impact the flight of the projectile being launched. Also, nothing specifically prevents excessive stretching of the elastic bands which could cause damage to the bands and/or bring the projectile too far rearward. Either of these events could damage the equipment and/or harm the person using the device. Furthermore, little is available to limit damage and/or harm in the event that one of the elastic bands breaks. In other words, a need continues to exist for a slingshot or sling bow which is relatively safe and easy to use, as well as cost effective to manufacture.

SUMMARY OF THE INVENTION

In a preferred embodiment, the present invention provides a hand-held, projectile launching apparatus, which may be referred to as a sling bow. In one respect, the present invention is believed to facilitate relatively more comfortable and reliable use of such an apparatus. In this regard, the projectile launching portion of the apparatus is connected to the handle portion by means of a universal joint. As a result, the launching portion is free to pivot about both the longitudinal axis of the handle and an axis extending perpendicular to the longitudinal axis, thereby accommodating any desirable spatial relationship between the user's two hands. This "universal" freedom of movement renders the apparatus more comfortable in use and reduces the chance of arrow deflection or misalignment In another respect, the present invention is believed to be safer than conventional elastic resistance devices. In this regard, elastic tubes are used to launch a projectile, and a tether is disposed within each elastic tube to prevent stretching of either elastic tube beyond the elastic limit thereof. The tethers also tend to reduce the likelihood of injury in the event that an elastic tube breaks.

In other respects, the preferred embodiment of the present invention provides a sling bow having individually adjustable elastic tubes, a collapsible handle for convenient storage, and reversible arrow supports and aiming sights to accommodate both right-handed shooters and left-handed shooters. Many such advantages of the present invention may become apparent as a result of the more detailed description of the preferred embodiment which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
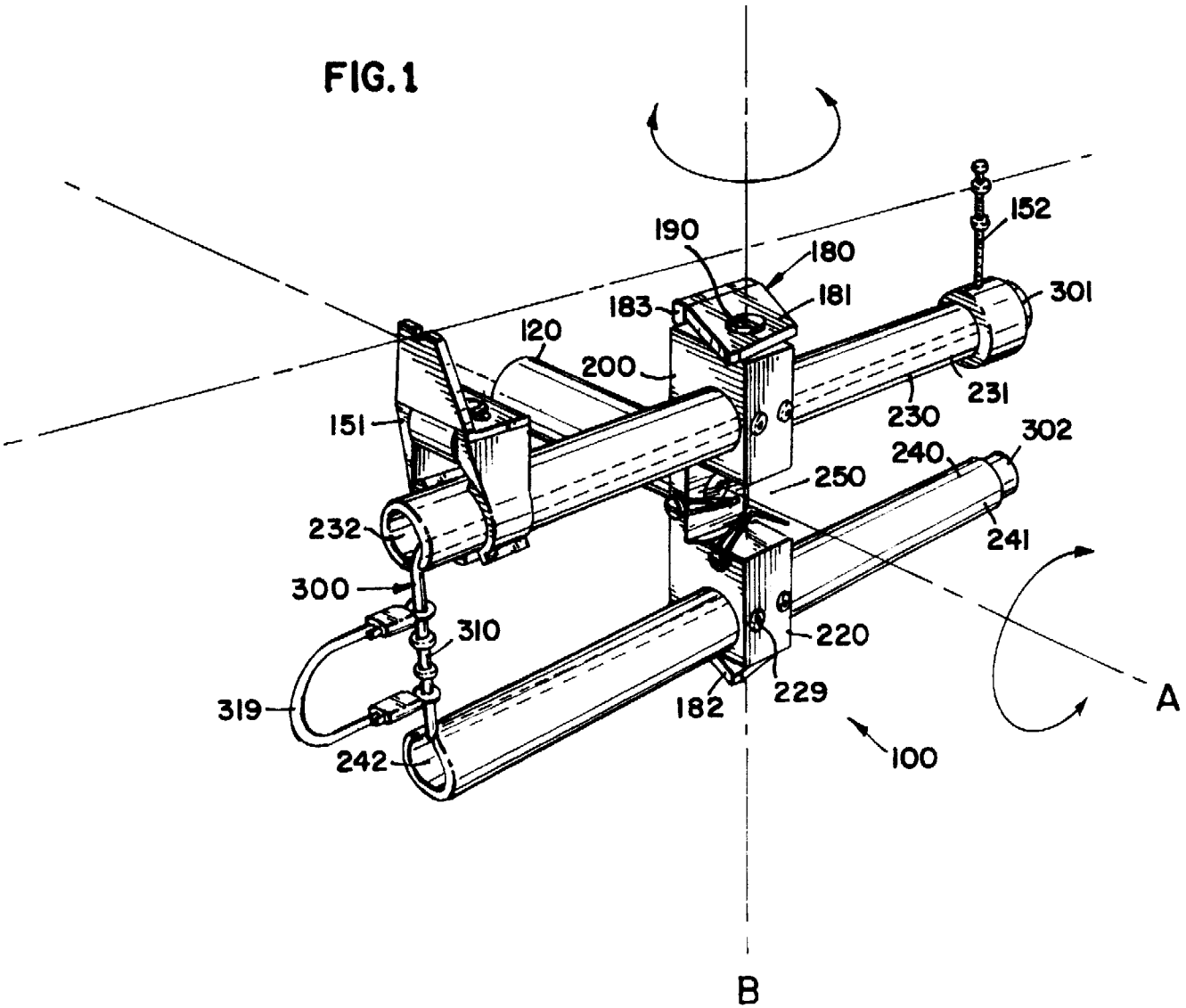
FIG. 1 is a perspective view of a sling bow constructed according to the principles of the present invention.

A preferred embodiment hand-held, projectile launching apparatus constructed according to the principles of the present invention is designated as 100 in FIG. 1. The apparatus 100 may also be referred to as a sling bow. Those skilled in the art will recognize that some aspects of the present invention may be applicable in other fields, such as exercise equipment, as well. The apparatus 100 generally includes a handle 120, a base 200, a bracket 180 interconnected between the handle 120 and the base 200, and an elastic member 300 connected to the base 200.

The handle 120 is a tube, which may be made from PVC or any other suitable material, having a longitudinal axis A. A first enlarged bore extends into a first end of the tube 120 to receive a bushing made from nylon or any other suitable material. A second enlarged bore extends into a second, opposite end of the tube 120 to accommodate another bushing, as well as the enlarged head of a screw 128 or other suitable fastener. A rod 124, which may be made from aluminum or any other suitable material, is disposed within the tube 120 and extends from the second enlarged bore, through the bushing, and beyond the first end of the tube 120. The protruding end of the rod 124 is threaded for reasons explained below, and the opposite end of the rod 124 is tapped to receive the threaded end of the screw 128. The screw 128 is inserted into the second end of the tube 120 and threaded into the tapped end of the rod to rotatably mount the tube 120 on the rod.

Figure 2:
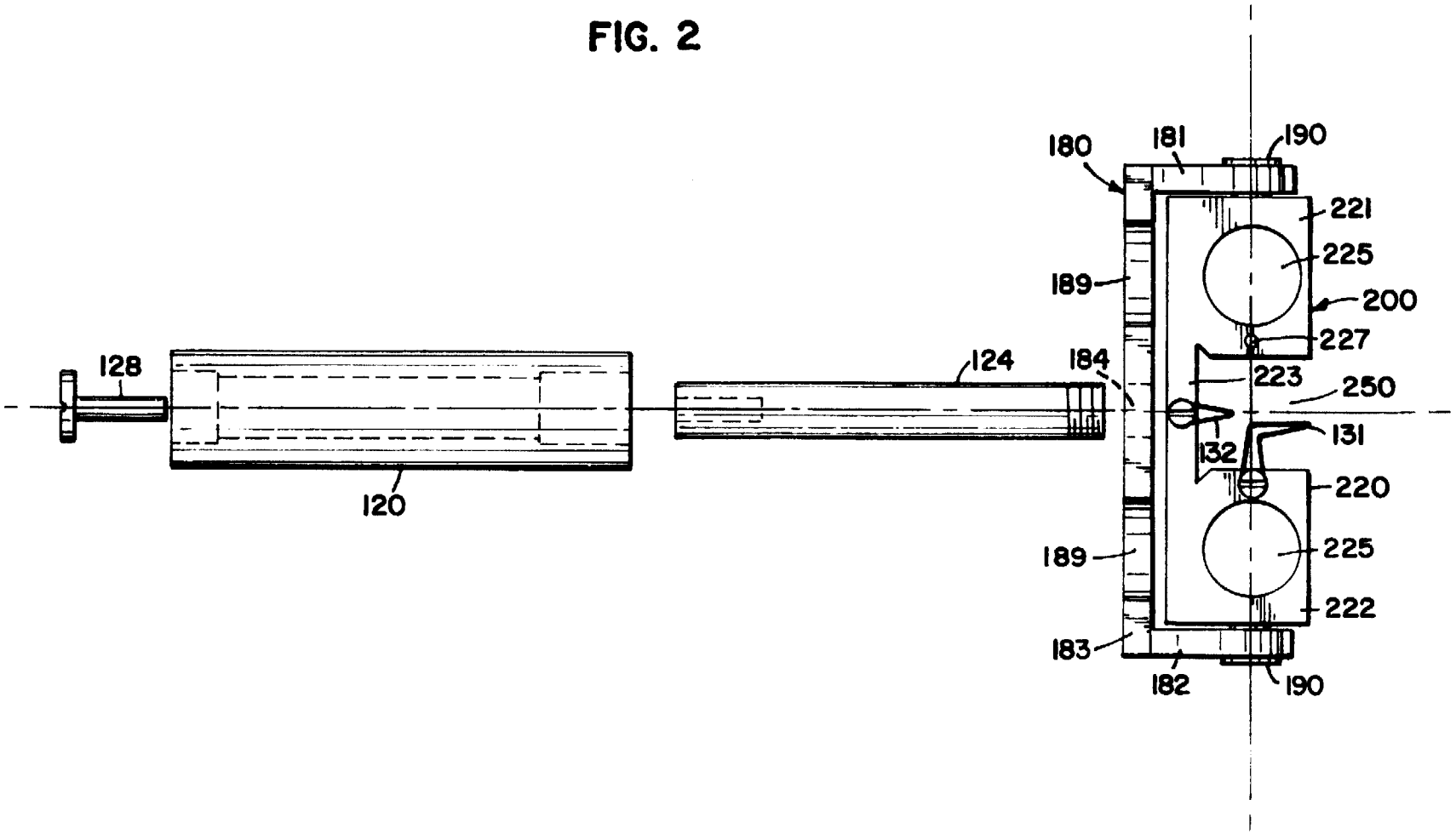
FIG. 2 is a partially exploded rear view of part of the sling bow shown in FIG. 1.

The bracket 180 is generally U-shaped and made from aluminum flat stock or any other suitable material. In particular, the bracket 180 includes side flanges 181 and 182 which are connected to opposite ends of an intermediate flange 183, by means of screws or other suitable fasteners. The side flanges 181 and 182 extend parallel to one another and perpendicularly away from the intermediate flange 183. As shown in FIG. 2, a threaded hole 184 extends through the intermediate flange 183, proximate its geometric center, to receive the threaded end of the rod 124. This arrangement facilitates relative rotation between the bracket 180 and the handle 120 about the longitudinal axis A.

The base 200 includes a generally U-shaped block 220 and two elongate tubular supports 230 and 240, all of which may be made from PVC or any other suitable material. The block 220 includes side members 221 and 222 which are connected to opposite ends of an intermediate member 223, as a result of integral construction or by other suitable means. The side members 221 and 222 extend parallel to one another and perpendicularly away from the intermediate member 223, and they cooperate to define a gap 250 therebetween. A longitudinal bore 225 (perpendicular to the generally U-shaped profile) is formed through each side member 221 and 222 to receive a respective tube 230 and 240. The tubes 230 and 240 extend generally parallel to one another and are secured in place within a respective bore 225 by screws 229 or other suitable means.

An additional, relatively smaller, longitudinal bore 227 is formed into each side member 221 and 222 to selectively retain a first arrow support 131, as more fully explained below. A similar longitudinal bore 228 is formed into the intermediate member 223 to retain a second arrow support 132, as more fully explained below.

Figure 3:
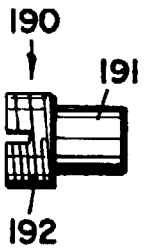
FIG. 3 is a side view of a fastener on the sling bow shown in FIGS. 1 and 2.

A lateral bore (perpendicular to the longitudinal bores 225, 227, and 228) is formed into each side member 221 and 222 and intersects a respective bore 225 to receive a respective fastener 190. In particular, each lateral bore aligns with a hole formed through a respective side flange 181 and 182. Each fastener 190, one of which is shown in greater detail in FIG. 3, includes a shaft 191 and an enlarged head 192. The shaft 191 has a smooth cylindrical surface, and the head 192 bears helical threads. The head 192 is also slotted to receive the tip of a standard screwdriver.

The shaft 191 of a respective fastener 190 is inserted through each side flange 181 and 182 and into a respective lateral bore. The head 192 of each fastener 190 is threaded into engagement with a respective side flange 181 and 182.

When so arranged, the fasteners 190 share a common axis B, and capture the block 220 therebetween. This arrangement facilitates relative rotation between the base 200 and the bracket 180 and the handle 120 about the common axis B.

Figure 4:
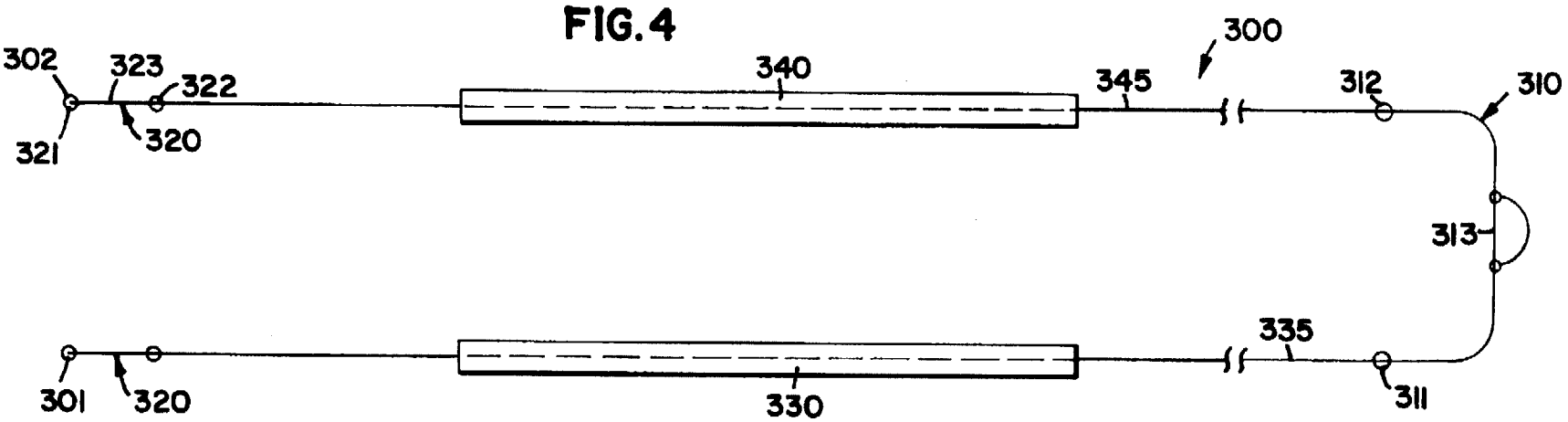
FIG. 4 is a diagrammatic view of the launching system on the sling bow shown in FIG. 1.
Figure 5:
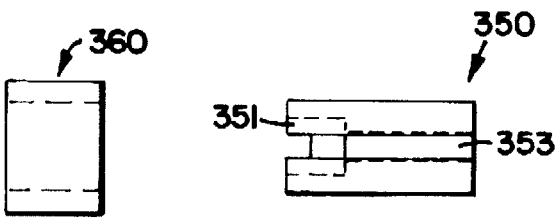
FIG. 5 is an exploded view of adjustment members for the launching system shown in FIG. 4.

The elastic member 300 has a first end 301, a second end 302, and a projectile engaging portion 310 disposed therebetween. More specifically, as shown in FIGS. 4 and 5, the elastic member 300 includes a tension adjusting portion at each end 301 and 302 and elastic tubing extending from each tension adjusting portion to the projectile engaging portion 310. Each tension adjusting portion includes a segment 320, which may be made from braided nylon cord or any other suitable material. Each segment 320 has a first knotted end 321, a second knotted end 322, and an intermediate portion 323 extending therebetween. Heat is applied to each knotted end 321 and 322 to reduce the likelihood of the knot coming loose.

The first knotted end 321 of each segment 320 is secured to a respective bolt 350, which may be made from PVC or any other suitable material. An enlarged bore 351 is formed in one end of each bolt 350 to accommodate the first knotted end 321 of a respective segment 320, and an axial slot 353 is formed along each bolt 350 to accommodate the intermediate portion 323 of a respective segment 320. Each bolt 350 is cylindrical and has an outside diameter which is smaller than the inside diameter of a respective tube 230 and 240.

Each bolt 350 bears external threads which mate with internal threads on a respective nut 360, which also may be made from PVC or any other suitable material. Each nut 360 is cylindrical and has an outside diameter which is greater than the inside diameter of a respective tube 230 and 240. Thus, each nut 360 is constrained to remain outside a respective tube 230 and 240. The end of each bolt 350 associated with the knotted end 321 is threaded into a respective nut 360 to secure each end 301 and 302 of the elastic member 300 outside the forward end 231 and 241 of a respective tube 230 and 240.

The second knotted end 322 of each segment 320 is secured to an end of a respective elastic tube 330 and 340 and an end of a respective tether 335 and 345. The tethers 335 and 345 may be made from 80 pound test fishing line or any other suitable material. Those skilled in the art will recognize that other sizes and types of multi-filament line may be used depending on the strength of the elastic tubes and the desired factor of safety. Each tether 335 and 345 is disposed within a respective elastic tube 330 and 340, and each elastic tube 330 and 340 is disposed within a respective elongate tube 230 and 240. Each tether 335 and 345 is secured to a respective knotted end 322 by means of a knot or any other suitable means. Each elastic tube 330 and 340 is secured about a respective knotted end 322 by means of a tie wire or any other suitable means.

The projectile engaging portion or bow string 310 may be made from braided nylon cord or any other suitable material. The portion 310 has a first knotted end 311, a second knotted end 312, and an intermediate portion 313 extending therebetween. Axially extending slots are formed in the rearward ends 232 and 242 of the elongate tubes 230 and 240 to accommodate and guide the bow string 310. A pull loop 319 may be secured to the intermediate portion 313 of the bow string 310, if so desired, to accommodate any sort of release mechanism known in the art. Heat is applied to each knotted end 311 and 312 to reduce the likelihood of the knot coming loose. Each knotted end 311 and 312 is connected to a respective elastic tube 330 and 340 and a respective tether 335 and 345 in the same manner as the knotted ends 322. As illustrated in FIG. 4, the length of the tethers 335,345 between the knotted ends 311,322 and 312,322 is greater than the length of the elastic tubes 330,340, respectively. Therefore, when the ends of the tubes 330,340 are connected to the knotted ends 311,312,322, the tethers 335,345 are disposed within the tubes 330,340 in an untaut, or slack, condition. As a result, the elastic member 300 is effectively interconnected between the respective forward ends 231 and 241 of the elongate tubes 230 and 240 and thus, is capable of storing tension as the bow string 310 is pulled rearward. When the bow string 310 is at its rest position, the magnitude of tension in the elastic member 300 may be adjusted by rotating one or both bolts 350 relative to a respective nut 360. Those skilled in the art will recognize that rotation of one bolt 350 to the exclusion of the other will tend to alter the alignment of the bow string 310 relative to the gap 250.

The elastic tubes 330 and 340 may be said to be elastic, in that they are capable of elastically stretching to at least 150% of their unstressed length. On the other hand, the projectile launching portion 310, the segments 320, and the tethers 335 and 345 may be said to be relatively inelastic, in that they cannot elastically stretch to even 110% of their unstressed length. Force applied in a generally rearward direction against the bow string 310 is met with a reactionary force as the nuts 360 press against the respective forward ends 231 and 241 of the elongate tubes 230 and 240, thereby causing the elastic tubes 330 and 340 to stretch and accumulate potential energy. The tethers 335 and 345 are substantially longer than the unstressed elastic tubes 330 and 340, respectively, and thus, do not hinder stretching of the latter, except to prevent the elastic tubes 330 and 340 from being stretched beyond their elastic limit.

The apparatus 100 shown in FIG. 1 is configured for operation with a person's left hand on the handle 120 and a person's right hand in communication with the bow string 310. In this configuration, the tube 230 may be said to be the upper tube, and the tube 240 the lower tube. Thus, the first arrow support 131 is secured to the side member 222 (associated with the lower tube 240) by a screw or any other suitable means, in order to lie beneath an arrow extending through the gap 250. The second arrow support 132 is secured to the intermediate member 223 to resiliently maintain the arrow at a safe distance therefrom. Also, first and second sights 151 and 152 are secured to the upper tube 230 by a screw or any other suitable means, in order to assist a user in aiming the apparatus at a desired target. The rearward sight 151 clips into place on the tube 230, and the forward sight 152 slide into place. The apparatus 100 may be reconfigured for opposite hand operation simply by moving the sights 151 and 152 to the other tube 240, and by moving the first arrow support 131 to the other side member 221.

Although the present invention has been described with reference to specific embodiments and applications, the scope of the present invention is to be limited only to the extent of the claims which follow.

I claim:

1. A hand-held, projectile launching apparatus, comprising:

a base having a first support and a second support spaced apart from one another;

a handle secured to the base;

an elastic member having a first end, a second end, and a projectile engaging portion disposed therebetween, the first end being secured to the first support, and the second end being secured to the second support;

wherein the elastic member includes a first elastic portion connected to and extending between the first end and the projectile engaging portion, a second elastic portion connected to and extending between the second end and the projectile engaging portion, a first tether connected to and extending between the first end and the projectile engaging porting of the elastic member and a second tether connected to and extending between the second end and the projectile engaging portion.

2. The apparatus of claim 1, wherein the first and second elastic portions comprise tubes, and the first and second tethers are disposed within the first and second elastic tubes, respectively, and extend from one end of each tube to an opposite end of each tube.

3. The apparatus of claim 1, wherein each tether is a multi-filament line.

4. The apparatus of claim 1, wherein the projectile engaging portion includes a bow string.

5. The apparatus of claim 1, wherein each end of the elastic member is adjustably secured to a respective support to facilitate centering of the projectile engaging portion between the supports.

6. The apparatus of claim 5, wherein each end of the elastic member is secured to a respective bolt, and each bolt is secured to a respective nut, and each nut is disposed on a side of a respective support opposite the projectile engaging portion.

7. The apparatus of claim 1, wherein each support is an elongate tube, and each tube has a first end relative to which a respective end of the elastic member is secured, and an opposite end from which the projectile engaging portion extends.

8. A hand-held, projectile launching apparatus, comprising:

an elastic member having a first end, a second end, and a projectile engaging portion disposed therebetween;

a base having a first support and a second support disposed apart from one another, wherein the first end of the elastic member is secured to the first support, and the second end of the elastic member is secured to the second support;

a handle connected to the base in such a manner that the base is rotatable relative to the handle; and wherein the base is free to rotate relative to the handle about two orthogonal axes.

9. The apparatus of claim 8, wherein the elastic member generally defines a plane, and the base is free to rotate relative to the handle about an axis extending parallel to the plane.

10. The apparatus of claim 9, wherein the base is free to rotate relative to the handle about an axis extending perpendicular to the plane.

11. The apparatus of claim 8, wherein the elastic member generally defines a plane, and the base is free to rotate relative to the handle about an axis extending perpendicular to the plane.

12. The apparatus of claim 8, wherein the elastic member generally defines a plane, and the handle extends generally perpendicular to the plane when in an operative position.

13. The apparatus of claim 12, wherein the handle has a longitudinal axis, and the base is free to rotate about the longitudinal axis.

14. The apparatus of claim 12, further comprising a bracket interconnected between the handle and the base, wherein the handle has a longitudinal axis, and the bracket is free to rotate relative to the handle about the longitudinal axis of the handle, and the base is free to rotate relative to the bracket about an axis extending perpendicular to the longitudinal axis of the handle.

15. A hand-held, projectile launching apparatus, comprising:

an elastic member having a first end, a second end, and a projectile engaging portion disposed therebetween;

a base having a first elongate tube, a second elongate tube, and a gap disposed therebetween, wherein the first end of the elastic member is secured to one end of the first elongate tube, and the second end of the elastic member is secured to one end of the second elongate tube;

a handle secured to the base;

a pair of sight members sized and configured to be mounted on either elongate tube, and removably mounted on the first elongate tube.

16. The apparatus of claim 15, further comprising a first arrow support secured to the base and extending into the gap between the first elongate tube and the second elongate tube, and a second arrow support sized and configured to be mounted on either elongate support tube, and removably mounted on the second elongate tube and extending toward the first elongate support tube.

17. The apparatus of claim 15, wherein the elastic member includes a first elastic tube disposed within the first elongate tube and extending from the first end to the projectile engaging portion, and a second elastic tube disposed within the second elongate tube and extending from the second end to the projectile engaging portion.

18. The apparatus of claim 17, further comprising a first tether disposed within the first elastic tube and interconnected between the projectile engaging portion and the one end of the first elongate tube, and a second tether disposed within the second elastic tube and interconnected between the projectile engaging portion and the one end of the second elongate tube, wherein at least one of the tethers becomes taut before any portion of either elastic tube exceeds its elastic limit.

19. The apparatus of claim 18, further comprising a bracket interconnected between the handle and the base, wherein the handle has a longitudinal axis, and the bracket is free to rotate relative to the handle about the longitudinal axis of the handle, and the base is free to rotate relative to the bracket about an axis extending perpendicular to the longitudinal axis of the handle.

20. The apparatus of claim 17, wherein each elastic tube is adjustably secured to a respective elongate tube by means of a nut and bolt combination.

* * * * *